US007523531B2

(12) United States Patent
Schmitt et al.

(10) Patent No.: US 7,523,531 B2
(45) Date of Patent: Apr. 28, 2009

(54) PMC WITH SPLITTABLE FIBRES

(75) Inventors: Matthias Schmitt, München (DE); Hubert Walkenhaus, Kerpen (DE)

(73) Assignee: Voith Patent GmbH, Heidenheim (DE)

( * ) Notice: Subject to any disclaimer, the term of this patent is extended or adjusted under 35 U.S.C. 154(b) by 208 days.

(21) Appl. No.: 11/431,308

(22) Filed: May 9, 2006

(65) Prior Publication Data

US 2006/0281383 A1 Dec. 14, 2006

(30) Foreign Application Priority Data

May 10, 2005 (DE) ..... 10 2005 021 480
Aug. 16, 2005 (DE) ..... 10 2005 038 534

(51) Int. Cl.
*D04H 1/46* (2006.01)
*D04H 1/70* (2006.01)
*D04H 11/08* (2006.01)
*B32B 5/26* (2006.01)

(52) U.S. Cl. ..... 28/104; 442/268; 442/361; 442/362; 442/363; 442/340; 442/381; 442/387; 442/408; 442/415; 442/417

(58) Field of Classification Search ..... 442/381, 442/387, 340, 417, 408, 361, 362, 363, 415, 442/268; 28/104
See application file for complete search history.

(56) References Cited

U.S. PATENT DOCUMENTS 5,620,565 A * 4/1997 Lazorisak et al. ..... 162/72
5,853,628 A * 12/1998 Varona ..... 264/6
6,444,312 B1 * 9/2002 Dugan ..... 428/370
6,531,418 B1 3/2003 Lidar et al.
2003/0203695 A1 * 10/2003 Polanco et al. ..... 442/365
2004/0033748 A1 2/2004 Crook
2004/0151871 A1 8/2004 Telgmann

FOREIGN PATENT DOCUMENTS

EP 1 293 602 3/2003
JP 05-321186 * 12/1993
WO WO 99/32715 7/1999

OTHER PUBLICATIONS

European Search Report Sep. 5, 2006.

* cited by examiner

*Primary Examiner*—Norca L Torres-Velazquez
(74) *Attorney, Agent, or Firm*—Taylor & Aust, P.C.

(57) ABSTRACT

The invention relates to a fabric for a machine for producing and/or further processing a material web, in particular a fibrous web, having a carrier structure and a fiber batt, the fiber batt comprising fibers which, in order to form elongated fiber segments, can be split substantially along their longitudinal extent, at least in some sections, and/or which are split substantially along their longitudinal extent, at least in some sections, forming elongated fiber segments. Furthermore, the invention relates to a process for producing the fabric and to a method for conditioning the fabric in the machine for producing the material web.

4 Claims, 4 Drawing Sheets

PMC WITH SPLITTABLE FIBRES

CROSS-REFERENCE TO RELATED APPLICATIONS

The present application claims priority under 35 U.S.C. §119 of German Patent Application No. 10 2005 021 480.0 filed on 10 May 2005, and German Patent Application No. 10 2005 038 534.6 filed on 16 Aug. 2005, the disclosures of which are expressly incorporated by reference herein in their entirety.

BACKGROUND OF INVENTION

1. Field of the Invention

The invention relates to a fabric for a machine for producing and/or further processing a material web, such as a fibrous and/or cellulose web, in particular but not exclusively a papermachine fabric. Furthermore, the invention relates to a process for producing a fabric according to the invention and a method for conditioning a fabric located and circulating on a machine.

2. Discussion of Background Information

In papermachine fabrics, the quality of the paper produced on them is influenced critically by the surface coming into contact with the paper. Therefore, for a long time during the development of papermachine fabrics, the aim has been to provide surfaces which mark the paper as little as possible. For example, in the case of press felt, the trend is to finer and finer fibres for the production of fibre batts that are as smooth as possible.

Furthermore, in order to achieve increasing drynesses in paper machines that run faster and faster, it is necessary to provide fibre batts which prevent rewetting of the paper web, for example in the press nip, better than the current fibre batts. In addition, for this application, fibre batts having pore structures that are finer than possible hitherto are needed in order to provide increased capillary pressures. These can likewise be produced with finer and finer fibres.

Technologically, no fibres having a titer of less than about 2 dtex can be processed at present to form fibre batts by means of carding, which means that limits are placed on the provision of finer and finer fibre batts for the production of papermachine fabrics.

SUMMARY OF THE INVENTION

The object of the present invention is to propose a fabric, in particular a papermachine fabric, by means of which the above disadvantages are overcome.

According to the invention, a fabric for a machine for producing and/or further processing a material web, in particular a fibrous web, which has a carrier structure and a fibre batt is provided, the fibre batt comprising fibres which, in order to form elongated fibre segments, can be split substantially along their longitudinal extent, at least in some sections, and/or which are split substantially along their longitudinal extent, at least in sections, forming elongated fibre segments.

The splittable fibres in the sense of the invention can be split into a large number of fibre segments, the fibre segments extending in the original longitudinal extent of the splittable fibre. Following splitting, a splittable fibre in the sense of the invention firstly forms in its longitudinal extent a section formed of the fibre segments and, adjacent thereto, a fibre portion which is still unsplit, into which all the fibre segments of the fibre merge. In a split fibre in the sense of the invention, the fibre segments in a common section of the longitudinal extent of the fibre are accordingly no longer joined to one another and, in another, common section of the fibre, are still joined to one another. Accordingly, one long end of a fibre segment is loose and the other long end of a fibre segment is joined to the other long ends of the other fibre segments of this fibre.

This property of the split fibres is to be seen as distinct from a fibrillated fibre in which, following the fibrillation, a common fibre stem remains, to which all the fibrils are joined, in the case of a fibrillated fibre, no section comprising common loose fibrils and an adjacent section comprising fibrils joined to one another being formed in the longitudinal extent of the fibre.

The split section of a splittable fibre in the sense of the invention can accordingly be formed for example from a large number of fibre segments of the same order of magnitude or same size, for example the same cross-sectional area, whereas a fibrillated fibre forms a large number of fibrils and a fibre stem, to which the fibrils are fixed. In the last-named case, the fibre stem is larger than the fibrils.

By providing a fabric having splittable fibres, which are either already split or are split, for example during the paper production process, it is possible to produce a fibre batt having fibre segments that are so thin that this was not possible with the fibres known from the prior art. Such a fibre batt is distinguished by a fine and smooth surface having little tendency to marking of the material web produced on it. Furthermore, such a fibre batt has extremely fine pores and can therefore be used as an anti-rewetting layer with enhanced functionality.

Different possibilities for constructing a splittable fibre in the sense of the invention are conceivable. According to a preferred refinement of the invention, provision is made for a splittable fibre to be formed by fibre segments which, in order to form the unsplit fibre, are joined to one another substantially along their entire longitudinal extent before splitting, it being possible for the joint to be detached by an external influence. In this refinement of the invention, in the split fibre, the fibre segments are then arranged loosely in relation to one another along a common section extending in the longitudinal extent of the fibre and still joined to one another along a further common section of the fibre adjoining the latter in the longitudinal extent of the fibre.

The fibre segments can, for example, have a cross-sectional area in the μm range or smaller.

The splittable fibres can be split both into an even and into an odd number of fibre segments.

Preferred splittable fibres can, for example, be split into at least 2 or 4 or 16 or 32 or 64 or more fibre segments, the fibre segments, starting from the diameter of the initial fibre, becoming thinner and thinner as the number of fibre segments rises, which means that the fibre batts produced by means of these have a finer and finer pore structure and smoother surface. As a result of the ability of the splittable fibres to be segmented, the permeability of the fibre batt can also be influenced.

The splittable fibre can preferably be split into fibre segments of identical cross-sectional shape and/or area. However, applications are also conceivable in which it is expedient if the splittable fibre can be split into fibre segments of non-identical cross-sectional shape and/or area.

According to a preferred refinement of the invention, provision is made for the splittable fibre to comprise fibre segments which are formed of mutually different materials. By means of the splittable fibre, a large number of functions and properties can thus be provided in the fibre batt in a simple manner. For instance, a fibre segment can contribute to the improved mechanical stability of the fibre batt, by this joining to other fibre segments at crossing points. Another fibre segment of the splittable fibre can, for example, influence the hydrophobic or hydrophilic properties of the fibre batt. Once again, another fibre segment has, for example, specific elastic properties, the effect of which is that the fibre batt rapidly assumes its initial shape following the end of an action of force.

Of course, it is also conceivable that all the fibre segments of a splittable fibre are formed from the same material, mutually adjacent fibre segments in each case forming an interface.

According to a concrete configuration of the invention, segments adjoining one another two-dimensionally are formed from materials that are different from one another, which form an interface with one another. In this case, the material preferably comprises a polymer material which, on its own or in combination, can comprise PA, PE, PET, PPS, PEEK, PU or polypropylene.

In order, firstly, to ensure that the splittable fibres can be processed to form a fibre batt and, secondly, to ensure a sufficiently easy ability to split the fibres in the finished fibre batt, a preferred embodiment of the invention provides for mutually adjacent fibre segments to be joined to one another by means of adhesion forces. Further possibilities for joining the fibre segments are adhesive bonds with adhesives which can possibly subsequently be released and do not necessarily react to mechanical stress or old adhesive bonds which split as a result of mechanical loading. At least partial sheathing of the fibres is also conceivable, which can then be completely or partly detached in order to split the fibre into fibre segments. It is also conceivable that there are zones with different properties, one region splitting to a greater extent than another; in this case a bandwidth from completely splittable to not splittable at all is possible.

For an extremely wide range of applications, it is necessary for the fibres to be split with differing levels of ease. For instance, in a fibre batt which forms the surface of the papermachine fabric coming into contact with the paper web, it may be expedient that its splittable fibres can be split easily, so that, in the event of abrasion of the split fibre parts, the surface of the fabric can easily be regenerated, for example by splitting the still unsplit fibre parts with a high pressure water jet. On the other hand, the ability to be split easily is not necessary or desired, for example, in the case of fibres in a fibre batt in the interior of the papermachine fabric, since here there is no abrasion of the fibres. Accordingly, a preferred embodiment of the invention provides for splittable fibres with a different ability to be split to be provided. This is intended to comprise both there being splittable fibres in a single fibre batt which have a different ability to be split and also the possibility that various fibre batts can be produced by using splittable fibres with a different ability to be split.

If a plurality of fibre batts with splittable fibres are provided, one of these fibre batts being an outer fibre batt, it is expedient if the splittable fibres of the outer fibre batt can be split more easily than the splittable fibres of the central fibre batt.

Advantageously, the ability of the fibres to be split can be adjusted as a function of the strength of the adhesion forces or can be adjusted by the strength of the sheath or the ability of the sheath to be detached.

In order to provide a fibre which, on the one hand, can still be processed to form a batt by the carding method but which, on the other hand, is sufficiently fine in order to form extremely fine fibre segments, such as microfibres, in the split state, it is expedient if the splittable fibres in the unsplit state have a titer of 1.7 dtex to 20 dtex, preferably of 2 dtex to 6.7 dtex.

Furthermore, it may also be expedient to use very coarse fibres. In this case, the batt can be carded simply by means of a few coarse fibres which are subsequently split into fine fibre segments. The splittable fibres for this purpose preferably have a range from 1 to 350 dtex.

A splittable fibre which corresponds to the requirements of the invention is currently marketed by Freudenberg AG under the trade name EVOLON™.

For the purpose of individual adjustment of the fibre batt to its intended use, it is expedient if the fibre batt comprises splittable fibres with different properties.

Furthermore, for some intended applications, it may be expedient if the fibre batt also comprises non-splittable fibres in addition to the splittable fibres. Non-splittable fibres can be used, for example, to adjust the pore structure (void volume) and/or the permeability of the batt. Furthermore, the non-splittable fibres can be hot-melt adhesive fibres, which contribute to improving the stability of the batt and/or to improving the joining of the fibre batts to one another.

For instance, particles dissolved in a solvent or powdery particles can also be introduced into the fibre batt having splittable fibres, in order to obtain an extremely fine surface with exactly adjustable permeability. Such a layer also has very good paper removal properties (sheet release). A preferred embodiment of the invention therefore provides for the fibre batt with splittable fibres to comprise polymer particles.

According to a further particularly preferred refinement of the invention, a plurality of fibre batts having splittable fibres are provided in the fabric according to the invention. For example, in order to provide a smooth and marking-free surface, it is conceivable for the fabric to have an outer layer that can be brought into contact with the material web and which is formed by one of the fibre batts having the splittable fibres. An anti-rewetting layer can be provided in the fabric, which is a central fibre batt having splittable fibres arranged between the two outer layers. In this case, for example, the splittable fibres of the outer fibre batt can be split into more fibre segments than the splittable fibres of the central fibre batt.

The different properties of the various fibre batts having the splittable fibres corresponding to the different requirements can preferably be adjusted by splittable fibres which, as compared with the splittable fibres of the other fibre batts, have at least one different property, being provided in at least one of the plurality of fibre batts.

Depending on its intended purpose, in order to adjust the desired property, it is of course also possible for at least one fibre batt having non-splittable fibres to be provided in the fabric according to the invention. Furthermore, it is of course possible for all other layers known in papermachine fabric technology for building up a fabric to be used in the fabric according to the invention.

The carrier structure of the fabric according to the invention can comprise, on its own or in combination: one or more woven fabrics, one or more unidirectional or multi-directional thread arrangements, a nonwoven two-dimensional structure which, for example, can be cast, or a film.

The fabric according to the invention is preferably a papermachine fabric, in particular a press felt, a forming fabric or a dryer fabric. In this case, the fabric according to the invention can be used for the production of all known paper grades, including board or tissue.

For example, by providing the fibre batt having the splittable fibres on the paper side, a forming fabric according to the invention with an extremely low tendency to marking and, at the same time, an improved dewatering behaviour—less rewetting and increased retention—as compared with the prior art can be provided.

Furthermore, for example, a dryer fabric according to the invention can be provided which has an extremely smooth paper-side surface and therefore considerably improved web guidance and lower air entrainment than the dryer fabrics known from the prior art.

The fabric according to the invention can also be used as a mesh belt filter in a stock preparation plant, such as is marketed, for example, by Voith under the trademark Variosplit™.

Furthermore, the fabric according to the invention can be used in a machine for the production of chemical pulp.

It is also the object of the invention to propose a process for producing a fabric according to the invention.

According to the invention, a process for producing a fabric for a machine for producing and/or further processing a material web is provided, having the following steps:

carding a fibre batt by using fibres which can be split substantially along their longitudinal extent, splitting at least some of the fibres substantially along their longitudinal extent in at least some sections in order to form elongated fibre segments.

Accordingly, a fibre batt having fibres which can be processed during the carding is firstly produced by the carding process. The fibres in the fibre batt produced are then split into thinner bundles of elongated fibre segments which cannot be processed by the carding process, in order to obtain a fibre batt having a fine pore structure and a smooth surface.

The process according to the invention can of course also be applied appropriately during the further development of the carding process with the objective of the ability to process smaller and smaller fibre diameters, such as are currently not yet conceivable.

A particularly preferred refinement of the process according to the invention provides that, following the carding of the splittable fibres to form the fibre batt and before the splitting of the fibres in the fibre batt, the fibre batt is joined to the layer of the fabric located underneath, in particular needled.

As an alternative to this, it is also conceivable that the fibre batt is joined to the layer of the fabric located underneath, in particular needled, only after the splitting of the fibres.

Furthermore, it is also possible to combine the two embodiments with each other, that is to say partly to split the splittable fibres following the carding of the fibre batt and before the joining to the layer located underneath and then, after the joining of the fibre batt, to split the splittable fibres further or to split other splittable fires located in the fibre batt.

To split the fibres, a mechanical process can be used, for example by means of a fluid jet under pressure, and/or a chemical process. Using a chemical process, for example, an acid-sensitive bond between the fibre segments can be dissolved in order to effect the splitting. Furthermore, by means of the chemical process, it is conceivable to dissolve a water-soluble component joining the segments to one another.

It is also an object of the invention to propose a method for conditioning a fabric according to the invention on the web-processing or web-producing machine, in particular the paper machine.

According to the invention, a method for conditioning a fabric circulating in a machine for producing and/or further processing a material web is provided, the fabric having an outer layer the surface of which can be brought into contact with the material web, and the outer layer comprising a fibre batt having splittable fibres, for the purpose of conditioning, a fluid jet under pressure being applied to the outer layer in such a way that the splittable fibres are split along their longitudinal extent, at least in some sections, forming elongated fibre segments.

According to the invention, a method is proposed in which split fibre parts removed from the fibre batt, for example as a result of abrasion during the production or further processing process of the material web are replaced by newly split fibre parts. This is done in that, during the conditioning for the purpose of regenerating the surface of the fabric coming into contact with the material web, new split fibre segments are produced by splitting, by which means the serviceability and lifetime of the fabric according to the invention is increased considerably as compared with conditioning methods in the case of known fabrics.

As a result of using a fluid jet for the splitting, recourse can be had to a simple and reliable technology which has proven to be worthwhile for use in web-processing machines. Furthermore, fluid jet devices already installed in the machine, such as spray pipes or fluid jet cleaning devices, can likewise be used for the conditioning according to the invention.

For the purpose of conditioning the surface of the fabric coming into contact with the material web, it is expedient if the splittable fibres are split at least in the region of the surface of the fibre batt.

According to an advantageous refinement of the invention, provision is made for the fluid jet to be applied in such a way that substantially only the parts of the splittable fibres that are arranged in the region of the surface are split into fibre segments.

The conditioning method according to the invention is preferably carried out during the production process, which means that stoppage times are reduced.

Furthermore, it is entirely conceivable for the fluid to be applied in such a way that the fabric is simultaneously cleaned during the splitting of the fibres.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
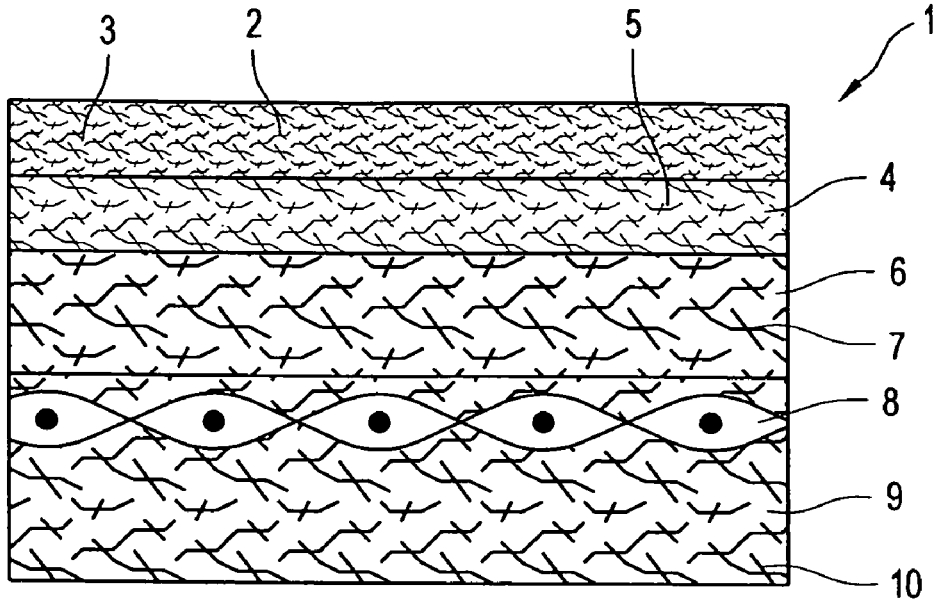
FIG. 1 shows a first embodiment of a fabric according to the invention designed as a press felt.

FIG. 1 shows a first embodiment of a fabric according to the invention designed as a press felt 1. The press felt 1 has an outer, upper fibre batt 2 which can be brought into contact with the paper web and has splittable fibres 3, which are already split in some sections and unsplit in some sections. In the present state of the press felt 1, substantially only the part of the splittable fibres 3 that are arranged in the region of the surface of the fibre batt 2 that can be brought into contact with the paper web have been split into fibre segments.

The fibres 3 of the fibre batt 2 have a circular cross-sectional shape in the unsplit state and are designed in such a way that these can be split into 32 fibre segments. In this case, fibre segments of identical cross-sectional shape, this is in the shape of a piece of pie, and area are formed.

In the present exemplary embodiment, the splittable fibres 3 comprise fibre segments which are formed from mutually different materials. In practical terms, this means that the segments adjoining one another two-dimensionally in the unsplit state of the fibre 3 are formed alternately of PA and PE, so that they form an interface with one another.

In the unsplit state, the mutually adjacent fibre segments are joined to one another by means of adhesion forces. A high-pressure water jet is preferably used to split the fibres 3.

The splittable fibres 3 used in the fibre batt 2 have a titer of about 2 dtex in the unsplit state, so that these could be processed by a carding process to form the batt 2. By means of splitting into 32 equal parts, fibre segments having a titer of 1/16 dtex are obtained, which provides a smooth and virtually marking-free surface of the press felt.

Moreover, the press felt 1 comprises a fine inner fibre batt 4 which, in FIG. 1, is arranged underneath the fibre batt 2. The fibre batt 4 is formed only from non-splittable fibres 5 with a titer of 10-20 dtex.

In FIG. 1, a coarse fibre batt 6 with likewise non-splittable fibres 7 with a titer of 50-300 dtex is arranged under the fibre batt 4.

In the press felt 1, a woven structure 8 is provided as carrier structure 8, which is arranged between the coarse fibre batt 6 and a further course fibre batt 9. The coarse fibre batt 9 is an outer layer of the press felt 1 and comprises non-splittable fibres 10 with a titer of 50-300 dtex.

Figure 2:
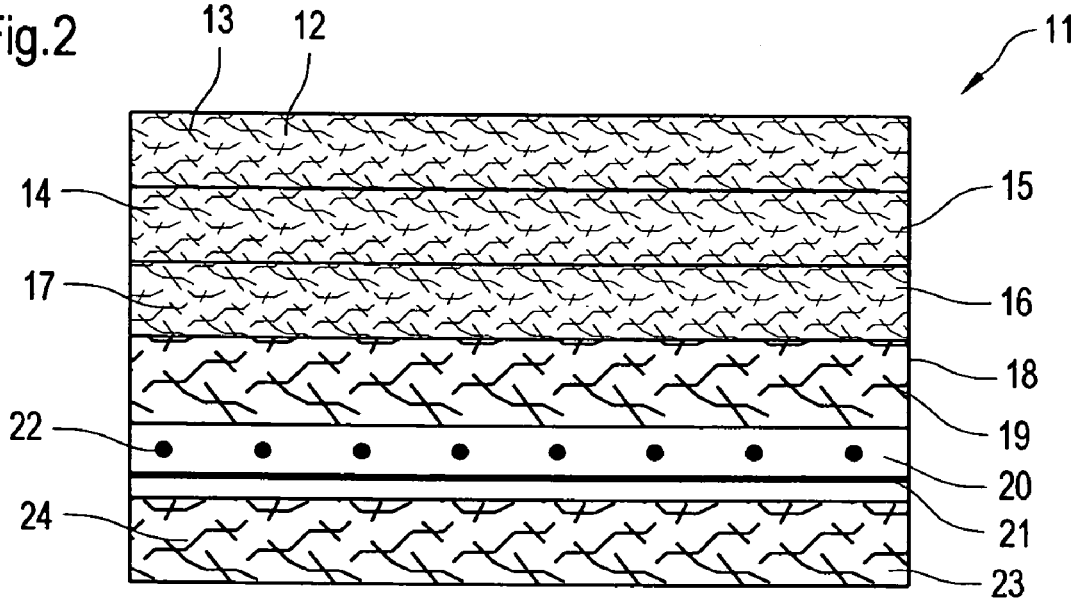
FIG. 2 shows a second embodiment of a fabric according to the invention designed as a press felt.

FIG. 2 shows a second embodiment of a fabric according to the invention designed as a press felt 11. The press felt 11 has an outer, upper fibre batt 12 that can be brought into contact with the paper web and has splittable fibres 13, which are already split in some sections and unsplit in some sections. The fibre batt 12 substantially corresponds to the fibre batt 2 from FIG. 1.

The press felt 11 further comprises a fine inner fibre batt 14 which, in FIG. 2, is arranged under the fibre batt 12. The fibre batt 14 is formed only from non-splittable fibres 15 with a titer of 10-20 dtex.

As opposed to FIG. 1, in FIG. 2 no coarse fibre batt having non-splittable fibres is arranged under the fine fibre batt 14; but rather a further fibre batt 16 having splittable fibres 17.

The splittable fibres 17 used in the fibre batt 16 have a titer of about 2 dtex in the unsplit state and can be split into 4 fibre segments with equal cross-sectional shape and area. The splittable fibres 17 have likewise been processed by a carding process to form the batt 16. As a result of splitting into four equal parts, fibre segments having a titer of 0.5 dtex are obtained, which means that the fibre batt 16 has a fine pore structure and can be used as an anti-rewetting layer.

Furthermore, the fibres 13 of the outer fibre batt 12 can be split more easily than the fibres 17 of the inner fibre batt 16. The ability to be split can be adjusted, for example, by means of the force of the adhesion forces prevailing between the unsplit fibre segments.

Furthermore, as compared with the splittable fibres 3 of the fibre batt 2, the splittable fibres 13 of the fibre batt 12 have at least one fibre segment provided with a hydrophobic coating.

In FIG. 2, a coarse fibre batt 18 analogous to the fibre batt 6 of FIG. 1 and having non-splittable fibres 19 with a titer of 50-300 dtex is arranged under the fibre batt 16.

The carrier structure 20 provided in the press felt 11 is a bidirectional thread structure 20, which is formed from a unidirectional thread arrangement 21 and a further unidirectional thread arrangement 22 running at right angles thereto.

The carrier structure 20 is arranged between the coarse fibre batt 18 and a further coarse fibre batt 23. The coarse fibre batt 23 is an outer layer of the press felt 11 and comprises non-splittable fibres 24 with a titer of 50-300 dtex.

Figure 3:
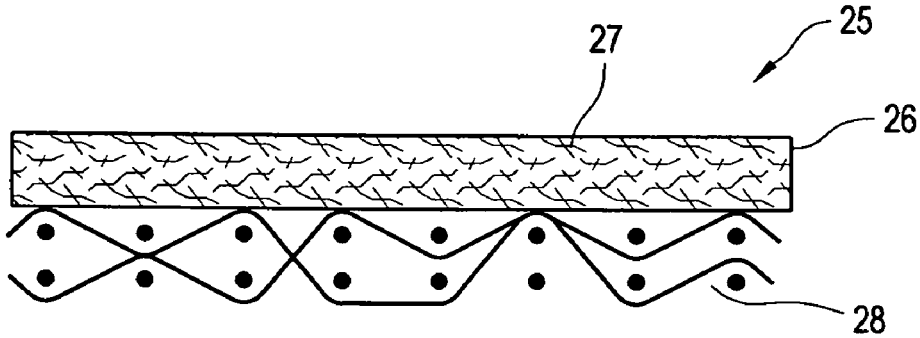
FIG. 3 shows a third embodiment of a fabric according to the invention designed as a forming fabric.

FIG. 3 shows a fabric according to the invention formed as a forming fabric 25 and having a fibre batt 26 of splittable fibres 27, which are in each case partly split into 32 fibre segments. The fibres 27 have an initial titer of 2 dtex. The fibres 27 of the fibre batts 26 differ from the fibres of the fibre batts 2 and 12 in that these comprise fibre segments of PET instead of PA. Furthermore, the fibre segments of the fibres 27 of the fibre batts 26 have a cross-sectional shape without edges, whereas those of the fibre batts 2 and 12 are rather flat.

The forming fabric 25 also has a woven carrier structure 28. The fibre batt 26 is also more highly compressed in the region of the elevations of the woven carrier structure 28 than in the regions of the carrier structure 28 without elevations, which forms a plane paper-side surface of the forming fabric 25.

Figure 4:
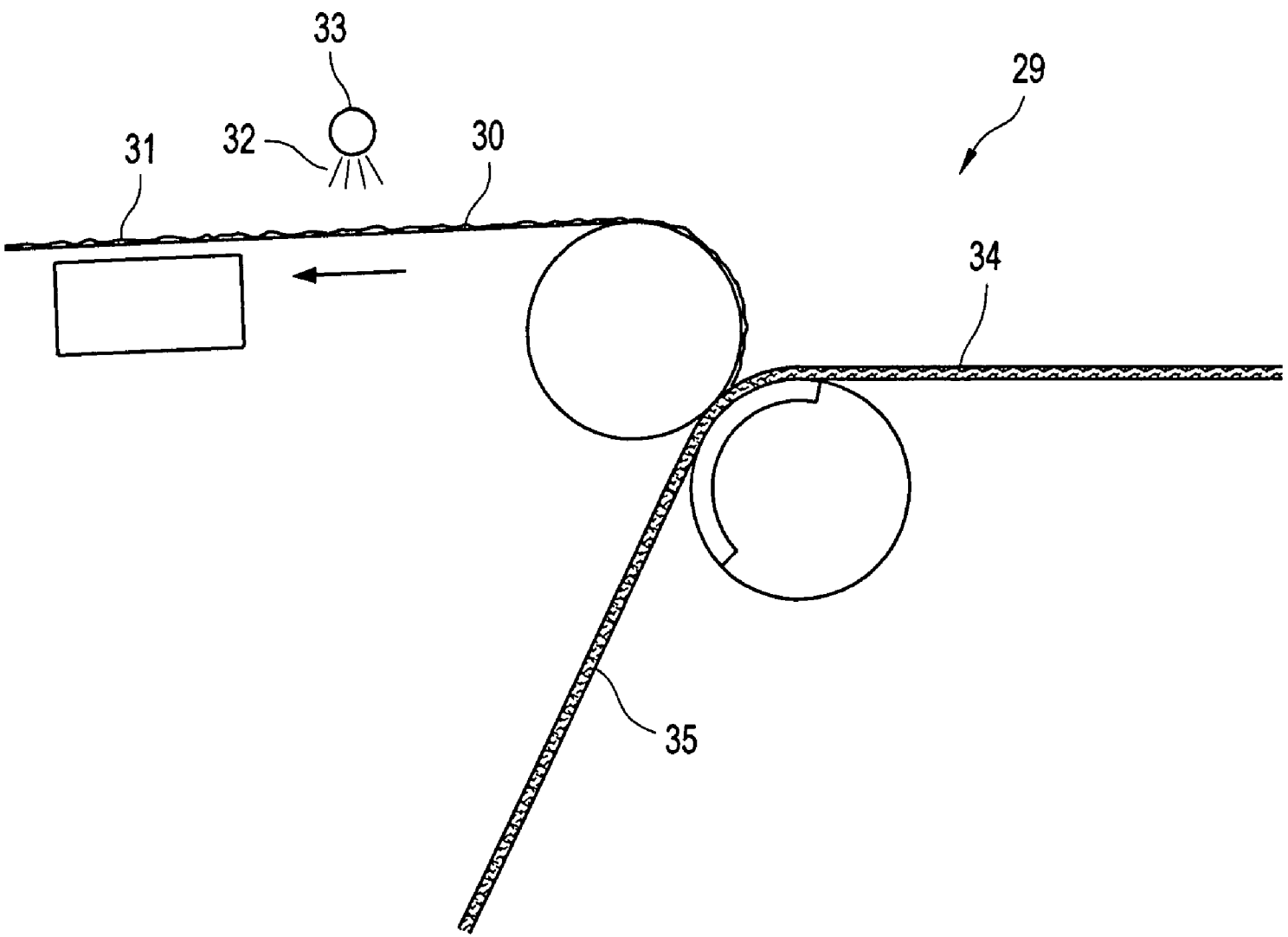
FIG. 4 shows a device for carrying out the conditioning method according to the invention.

FIG. 4 shows an extract from a paper machine 29 in which the method according to the invention for conditioning a circulating fabric 30 is carried out. The fabric 30 has an outer fibre batt 31 whose surface can be brought into contact with a paper web 34. The conditioning is carried out after the paper web 34 has been separated from the fabric 30 and is led onwards on another fabric 35. The fibre batt 31 of the fabric to be conditioned comprises splittable fibres. For the purpose of conditioning, the outer fibre batt 31 has applied to it a fluid jet formed as a water jet 32 under pressure from a spray pipe 33, in such a way that the splittable fibres are split along their longitudinal extent, at least in some sections, forming elongated fibre segments.

In this case, the method is preferably carried out in such a way that substantially only the part of the splittable fibres that are arranged in the region of the surface of the fibre batt 31 are split into fibre segments.

By means of the method according to the invention, the fibres of the fibre batt 31 whose split fibre segments have been removed by abrasion during the production or further processing process of the material web are regenerated by new split fibre segments being produced. In this way, regeneration of the surface of the fabric 30 coming into contact with the paper web 34 takes place, as a result of which the serviceability and lifetime of the fabric 30 according to the invention is increased considerably as compared with conditioning methods in the case of known fabrics.

Figure 5:
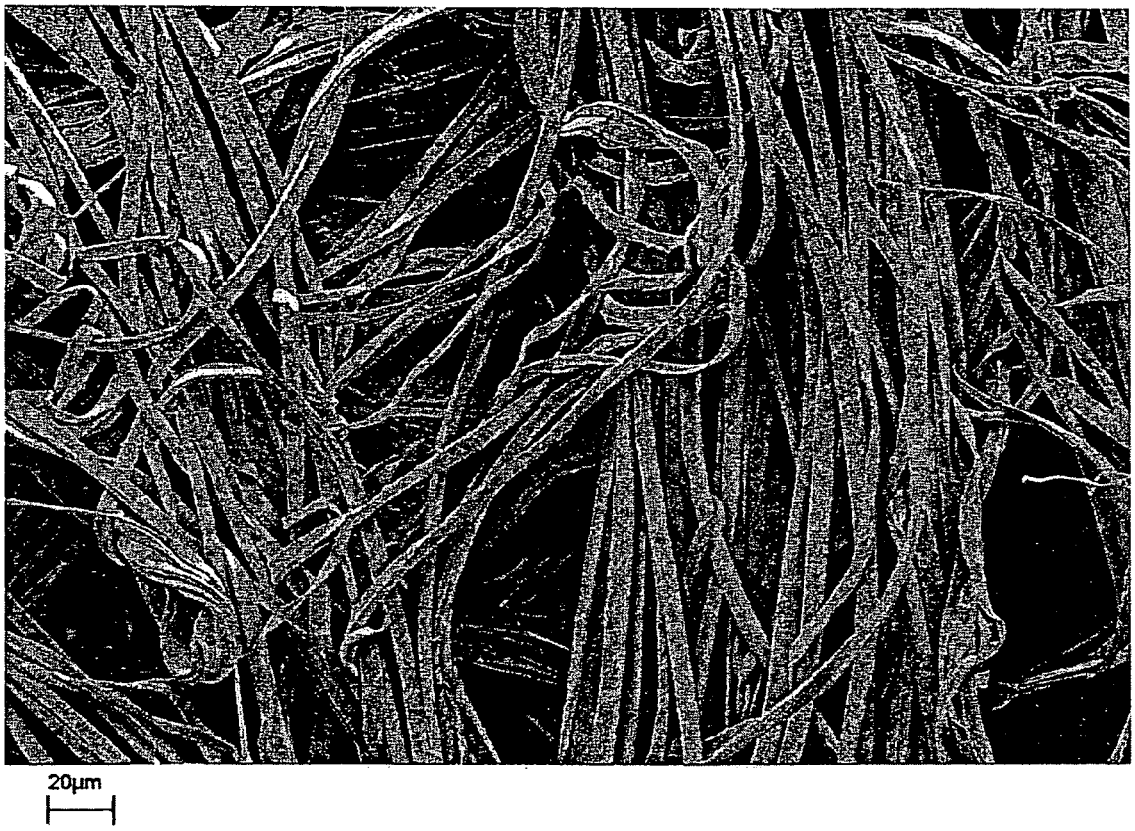
FIG. 5 shows an electron micrograph of a plurality of split fibres, as are used in the fabric according to the invention.

FIG. 5 shows an electron micrograph of a plurality of split fibres as are used in a fibre batt of a fabric according to the invention. The fibres shown are those which can be split into 32 fibre segments. The individual segments have a width of about 5 μm, as results from the scale at the bottom. The unsplit fibres have a circular cross-sectional shape. As a result of the splitting, 32 segments with the same cross sections in the shape of pieces of pie are produced.

Figure 6:
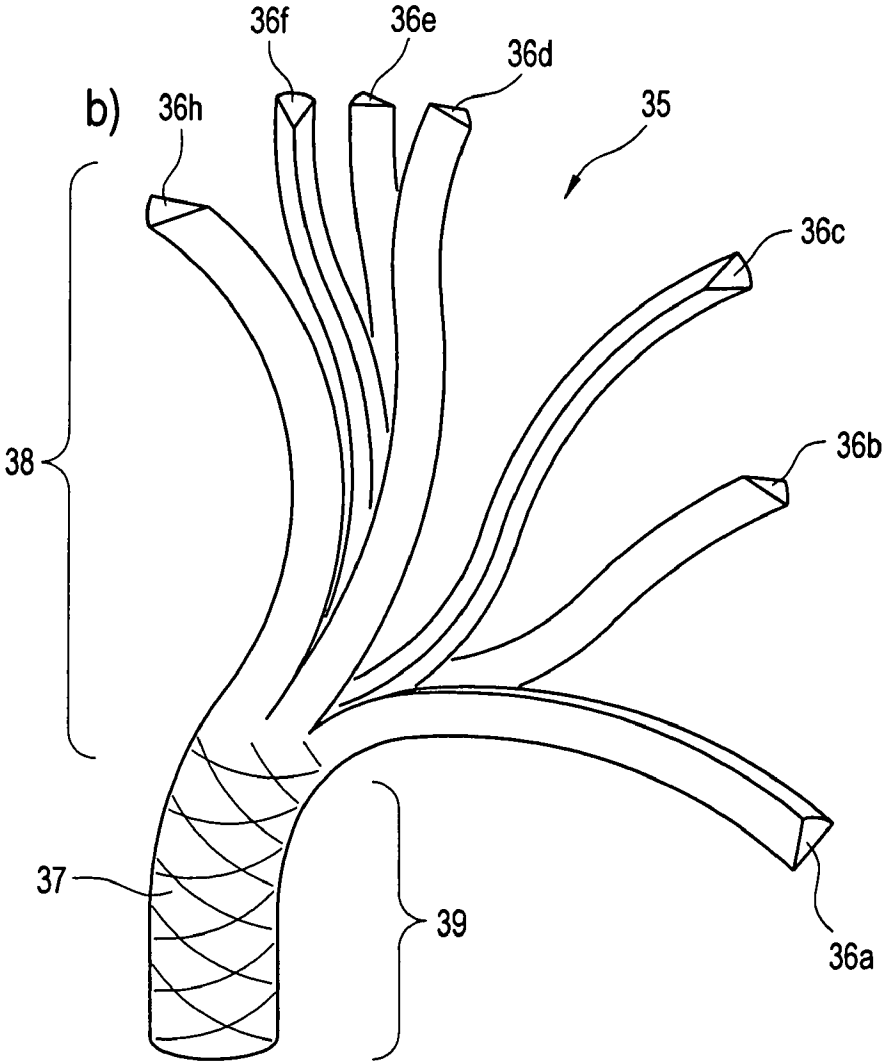
FIG. 6 shows a splittable fibre in the invention in the unsplit and split state.
Figure 6:
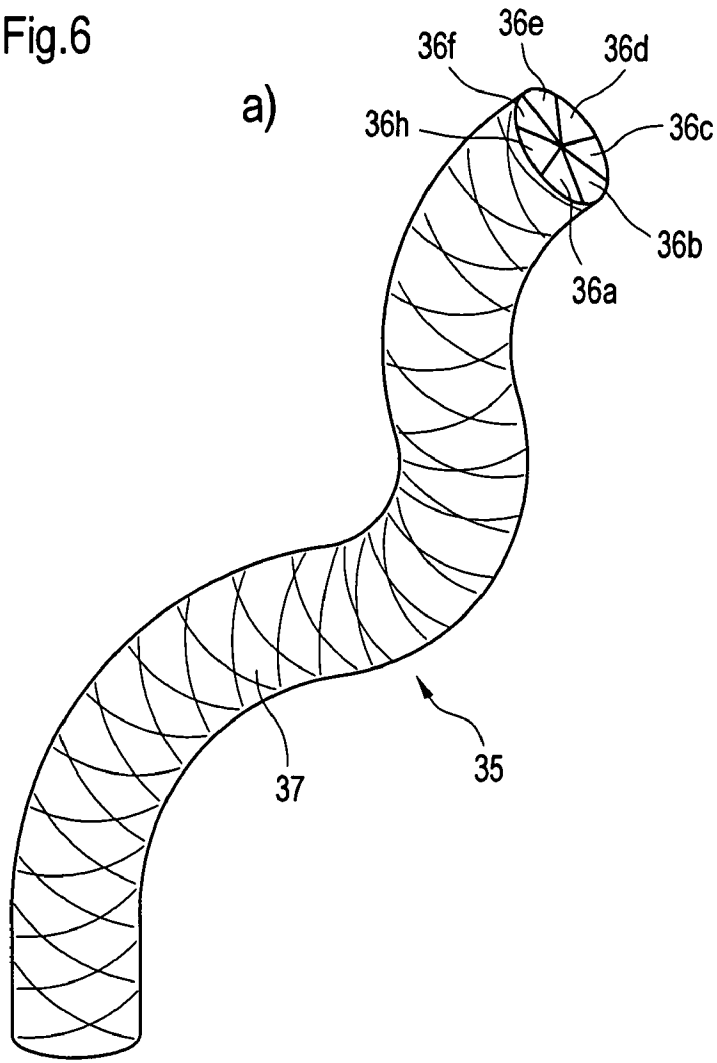

FIG. 6 shows a splittable fibre in the sense of the invention in the unsplit state (FIG. 6*a*) and in the split state (FIG. 6*b*).

The splittable fibre 35 in the sense of the invention shown in FIG. 6 is formed by a large number of fibre segments 36*a*-36*h* which are joined to one another substantially along their entire longitudinal extent in the unsplit state in order to form the splittable fibre 35.

In the embodiment illustrated in FIG. 6, all the fibre segments 36*a*-36*h* are formed from the same material. Furthermore, the fibre segments 36*a*-36*h* have, at least to some extent, mutually different cross-sectional areas.

In the unsplit state of the fibre 35, the fibre segments 36*a*-36*h* are joined to one another by a sheath 37.

By means of external action, the sheath 37 can be released in sections, as a result of which the fibre 35 is transferred into a "partly" split state, like the state shown in FIG. 6*b*. In the split state, the fibre segments 36*a*-36*h* are arranged loosely in relation to one another along a common section 38 extending in the longitudinal extent of the fibre 35, and are still joined to one another by the sheath 37 along a further common section 39 of the fibre 35 adjacent thereto in the longitudinal extent of the fibre.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims

The invention claimed is:

1. A method for conditioning a circulating fabric, the fabric having an outer layer the surface of which can be brought into contact with one of a transported or production product, which comprises a fibre batt having splittable fibres, comprising the step of applying a fluid jet under pressure to the outer layer in such a manner that the splittable fibres are split along their longitudinal extent, at least in some sections, forming elongated fibre segments, the conditioning being carried out during a paper web production process after the fabric has been separated from a paper web.

2. The method according to claim 1, whereby substantially only the parts of the splittable fibres that are arranged in the region of the surface are split into fibre segments.

3. The method according to claim 1, wherein the fluid jet is applied during the production process.

4. The method according to claim 1, whereby the fluid jet is applied in such a way that the fabric is simultaneously cleaned during the splitting of the fibres.

* * * * *